US007127859B2

(12) United States Patent
Domizio

(10) Patent No.: US 7,127,859 B2
(45) Date of Patent: Oct. 31, 2006

(54) HAND-HELD VOID-FORMING SYSTEM AND ANCHOR APPLICATOR

(75) Inventor: George Domizio, 106 Punkup Rd., Oxford, CT (US) 06478

(73) Assignee: George Domizio, Oxford, CT (US)

( * ) Notice: Subject to any disclaimer, the term of this patent is extended or adjusted under 35 U.S.C. 154(b) by 0 days.

(21) Appl. No.: 10/361,963

(22) Filed: Feb. 10, 2003

(65) Prior Publication Data

US 2003/0196403 A1 Oct. 23, 2003

Related U.S. Application Data

(60) Provisional application No. 60/355,532, filed on Feb. 8, 2002.

(51) Int. Cl.
*E04G 15/04* (2006.01)
*B28B 7/06* (2006.01)
*B28B 7/16* (2006.01)

(52) U.S. Cl. ..... 52/576; 52/125.4; 249/95; 249/185; 249/94

(58) Field of Classification Search ..... 52/125.4, 52/576; 24/557, 565, 508–511; 269/237, 269/254 R, 238, 6; 249/95, 142, 162, 170, 249/175, 185, 94
See application file for complete search history.

(56) References Cited

U.S. PATENT DOCUMENTS

| | | | | | |
|---|---|---|---|---|---|
| 140,659 | A | * | 7/1873 | Tunstill | 24/510 |
| D154,898 | S | * | 8/1949 | Blackmon | D32/64 |
| 4,063,333 | A | * | 12/1977 | Schweitzer | 24/567 |
| 4,813,107 | A | * | 3/1989 | Cetrone | 24/557 |
| 4,821,994 | A | * | 4/1989 | Fricker | 249/91 |
| 5,155,954 | A | * | 10/1992 | Roire | 52/125.5 |
| D350,892 | S | * | 9/1994 | Sorensen | D8/395 |
| 5,651,911 | A | * | 7/1997 | Pennypacker | 249/94 |
| D402,171 | S | * | 12/1998 | Miller | D8/4 |
| 5,876,026 | A | * | 3/1999 | Chen | 269/156 |
| 6,082,700 | A | * | 7/2000 | Lancelot et al. | 249/91 |
| 6,185,795 | B1 | * | 2/2001 | Shui-Shang | 24/507 |
| 6,575,424 | B1 | * | 6/2003 | Domizio | 249/91 |

* cited by examiner

*Primary Examiner*—Robert Canfield

(57) ABSTRACT

A hand-held void forming device, including a handle having two handle elements moveable relative to each other; and a void forming portion having two void forming elements moveable relative to each other, the void forming portion being operatively connected to the handle whereby movement of the handle elements relative to each other moves the void forming elements relative to each other.

11 Claims, 4 Drawing Sheets

HAND-HELD VOID-FORMING SYSTEM AND ANCHOR APPLICATOR

CROSS REFERENCE TO PROVISIONAL APPLICATION

This invention claims priority of Provisional Patent Application Ser. No. 60/355,532, filed Feb. 8, 2002.

BACKGROUND OF THE INVENTION

The invention relates to an apparatus for positioning an anchor in a concrete fabrication and for forming a void in the concrete fabrication to allow access to the anchor.

Various systems and methods have been provided for forming a void or space around such anchors in a concrete article. Two types of such article include those which are mounted to walls of the mold of the concrete, and those which are hand-held during at least a portion of the solidification of the poured concrete.

The present invention is drawn to the hand-held type of device. One problem frequently encountered with these types of devices is difficulty in removing the device from the hardened concrete when desired.

It is therefore the primary object of the present invention to provide for positioning of an anchor and forming of a void or space around the anchor as desired, while nevertheless facilitating removal of the device when desired.

SUMMARY OF THE INVENTION

In accordance with the present invention, a hand-held anchor applicator and void forming device is provided which has a handle portion and a void forming portion, wherein each of the handle portion and void forming portion includes two main components, each of which are pivotable relative to each other, such that manipulation of the handle portions can readily open the members of the void forming portions so as to facilitate removal from the concrete, and from around an anchor positioned within the concrete.

A particular advantage of the present invention is the provision of a spring within the handle of the device to bias the device toward a closed position, such that leakage of fluid or liquid concrete into any spaces between the components of the void-forming member is discouraged or prevented. This function of the present device is further facilitated by forming the article from a shape-memory material such that the rest position of the article is with both elements of the void-forming portion of the device pressed together.

BRIEF DESCRIPTION OF THE DRAWINGS

A detailed description of preferred embodiment of the present invention follows, with reference to the attached drawings, wherein.

DETAILED DESCRIPTION

The invention relates to an apparatus for positioning an anchor within a concrete fabricated article, and for forming a void or space around a portion of the anchor to allow access to same.

Figure 1:
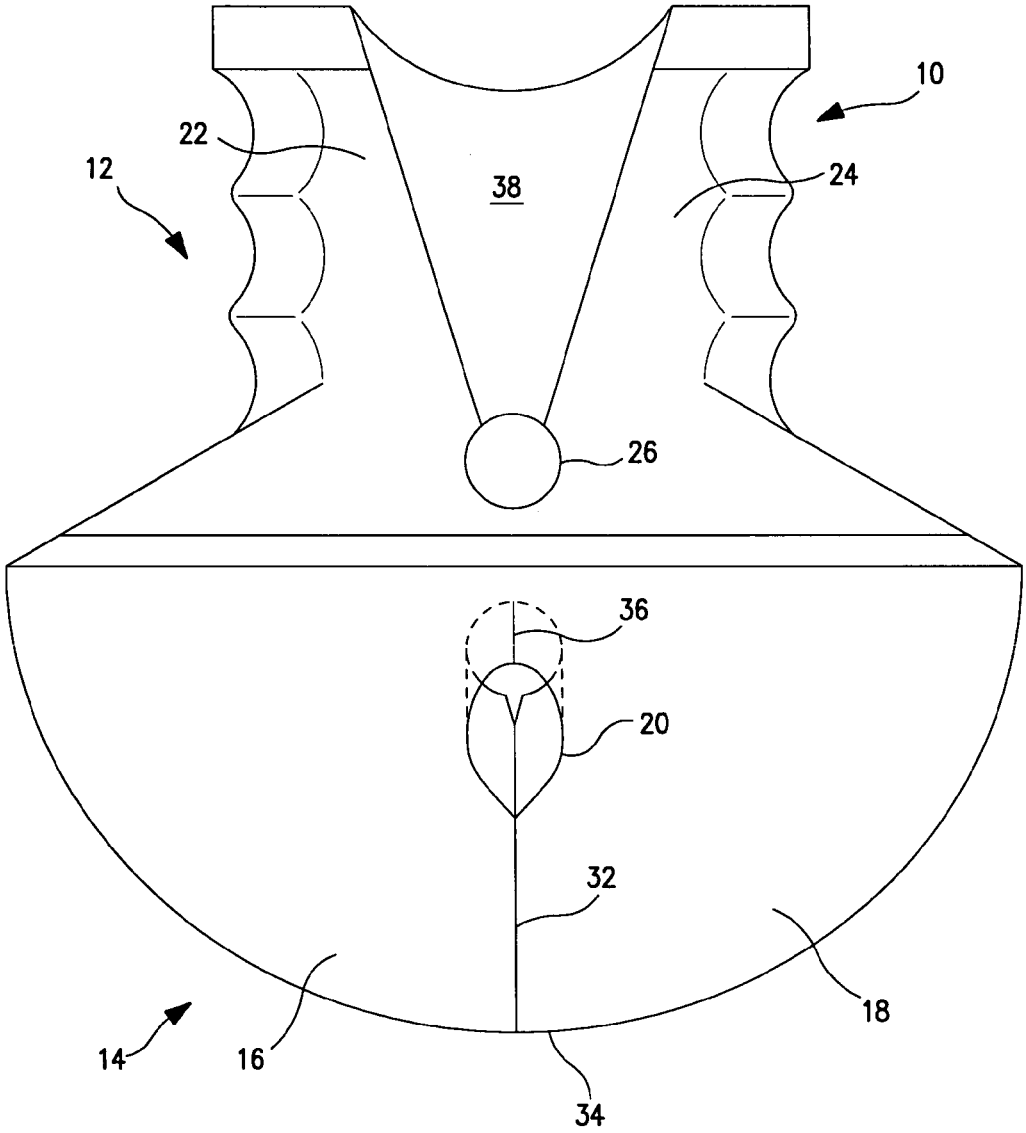
FIG. 1 is a side view of one embodiment of a hand-held void-forming article in accordance with the present invention.

FIG. 1 shows an embodiment of a hand-held anchor applicator 10 in accordance with the present invention, and has a handle portion generally referred to at 12 and a recess or void forming portion generally referred to at 14. As will be further illustrated below, applicator 10 in accordance with the present invention is used to position an anchor, typically in the form of an inverted-U shape piece of steel or other suitable material, into a poured concrete fabrication or article and hold the anchor in place while the concrete hardens, and further to form a void or recess in the concrete around a portion of the anchor to allow access to same as desired.

In this regard, recess forming portion 14 in the embodiment shown in FIG. 1 has generally the shape of a rounded-edged partial disc, and this shape is selected to provide the desired shape of the recess formed by same. Thus, in this embodiment, recess forming portion 14 preferably has two members 16, 18 which, in combination, form an outwardly partial disc-shaped member, and which are pivotable away from each other to an open position to facilitate positioning of an anchor (not shown in this drawing) in an anchor recess 20 formed between members 16, 18 as shown. With an anchor positioned in recess 20, applicator 10 can advantageously be used to position the anchor in a desired location in a concrete article.

FIG. 1 shows recess 20 having a contour, bending towards handle member 12 as it traverses between side faces of members 16, 18. Anchor recess 20 is preferably contoured in this manner so as to match the approximate shape of the portion of the anchor which is to be engaged by same.

Handle portion 12 preferably includes two handle members 22, 24 which are also pivotably mounted relative to each other, and which are adapted such that squeezing of handle members 22, 24 together pivots recess forming members 16, 18 away from each other to an open position as desired. In this regard, handle members 22, 24 can be provided having one or more finger grip portions as shown to facilitate gripping by hand. Handle members 22, 24 are further preferably adapted to pivot members 16, 18 open when handle members 22, 24 are closed, and to close members 16, 18, or allow them to close, when handle members 22, 24 are opened. Handle members 22, 24 are further preferably biased away from each other in accordance with the present invention so as to urge recess forming members 16, 18 toward each other in a rest position.

Handle members 22, 24 are further preferably adapted such that, in an open position as shown in FIG. 1, they are still comfortably held within one hand.

Still as shown in FIG. 1, handle portion 12 may further have a pivot-facilitating opening 26 positioned to allow easier closing of handle members 22, 24 when desired.

Figure 2:
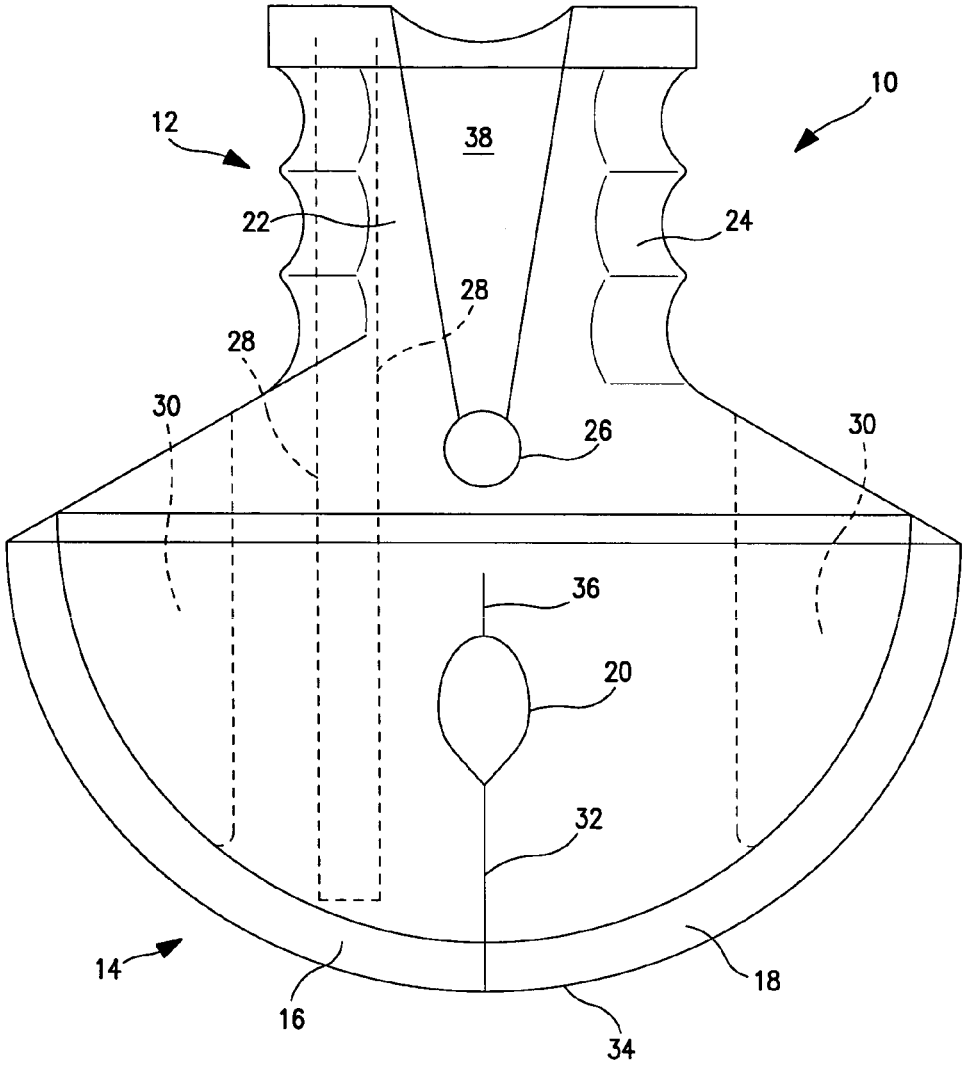
FIG. 2 is a further view of the embodiment of FIG. 1.

Turning to FIG. 2, further details of the embodiment of FIG. 1 are illustrated, wherein it is shown that a channel 28 may advantageously be formed within applicator 10, preferably extending through one or both of handle members 22, 24 and, if desirable, into recess forming members 16, 18 such that an elongated rod can be inserted into channel 28, and the rods can be used to assist in pivoting applicator 10 to an open position.

Further as shown by phantom lines in FIG. 2, recess forming portion 14 may advantageously have several voids 30 positioned therein, which advantageously serve to reduce the material from which applicator 10 is made, reduce the weight of applicator 10, and which may make manipulation of applicator 10, for example to position an anchor within recess 20, more easily accomplished.

As shown in FIGS. 1 and 2, recess forming members 16, 18 preferably meet at a parting line 32, and parting line 32 may advantageously extend from recess 20 to the peripheral edge 34 of recess forming portion 14, and may further include an oppositely extending portion 36 extending toward handle portion 12 from anchor recess 20 so as to facilitate a complete opening of recess forming members 16, 18 as desired.

Figure 3:
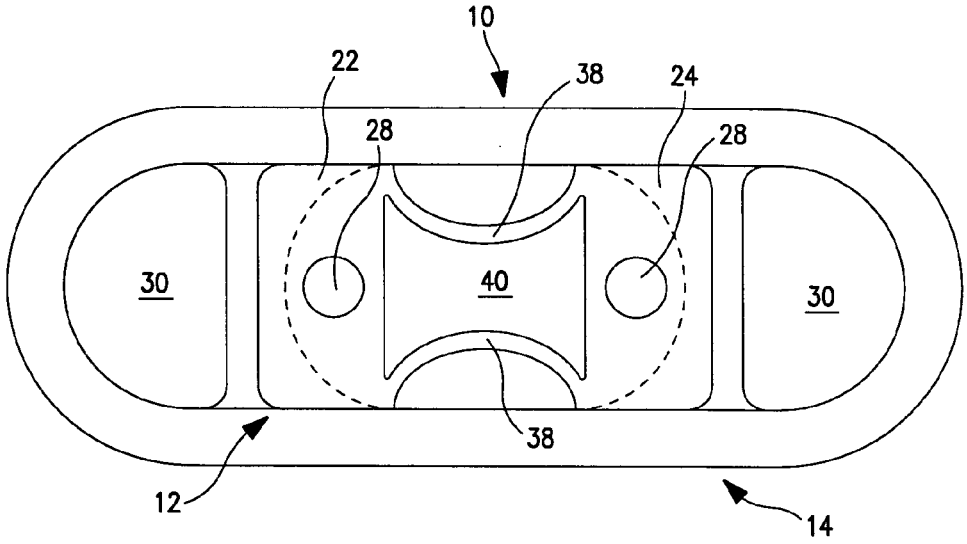
FIG. 3 is a top view of the embodiment of FIG. 1.

FIG. 3 shows a top view of the embodiment of FIGS. 1 and 2, and shows voids 30 as well as channels 28 as discussed above. Further, as shown in FIG. 3, a resilient web 38 may advantageously be positioned between handle members 22, 24, preferably with a space or void 40 positioned therebetween, which web 38 can serve to enhance operation of the device, for example by urging handle members 22, 24 toward an open position, and collapsing when handle members 22, 24 are squeezed to a closed position.

Figure 4:
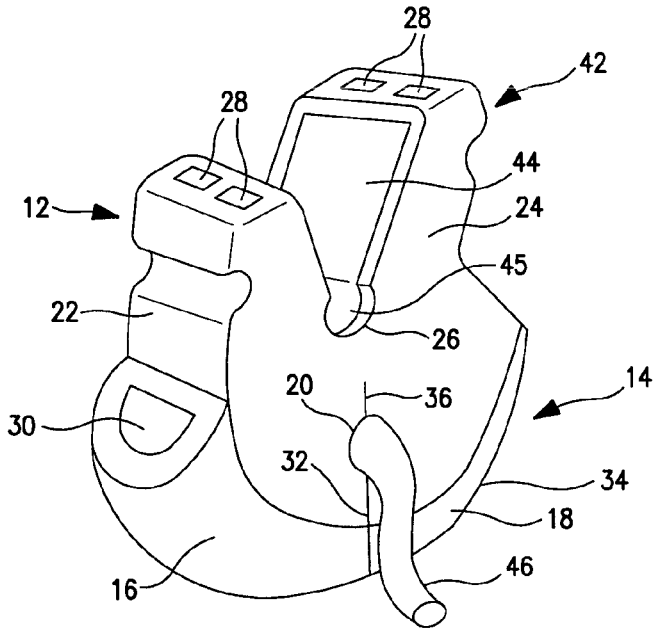
FIG. 4 is a perspective illustration of a preferred embodiment of the present invention.

Turning now to FIGS. 4–7, a further preferred embodiment of the present invention is illustrated. FIG. 4 shows an applicator 42 which is structurally similar to that of the embodiment of FIGS. 1–3, but which has several different features. As shown in FIG. 4, rather than a resilient web between handle members 22, 24, a spring member 44 is advantageously positioned between handle members 22, 24 and biases them toward an open position, as shown, to further assist in urging applicator 42 into a closed position wherein recess forming members 16, 18 are pressed tightly together along parting line 32, and handle members 22, 24 are spread to the open position as shown.

Note also that in this embodiment, two channels 28 are positioned in each handle member 22, 24.

As set forth above, opening 26 is preferably positioned substantially at a pivot point for handle members 22, 24, to assist in such pivot. In this embodiment, spring 44 may advantageously be provided having a rounded base portion 45 which is adapted to substantially match the contour of opening 26. This advantageously serves to help hold spring 44 in position between handle members 22, 24 as desired, and further provides for the desired squeezability of handle members 22, 24, while nevertheless biasing such handles back toward an open position.

It should also be noted that FIG. 4 shows an anchor 46 positioned in anchor recess 20 in a position suitable for use.

Figure 5:
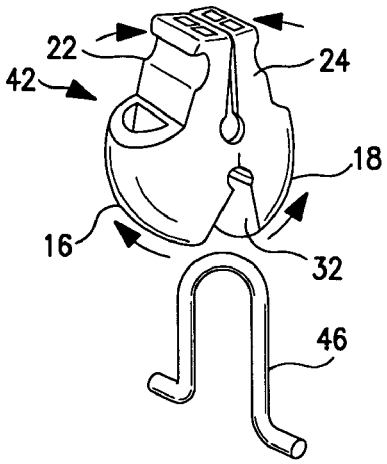
FIGS. 5–7 illustrate use of the embodiment of FIG. 4 to position an anchor within a concrete article, and form a void or space around a portion of the anchor as desired.
Figure 6:
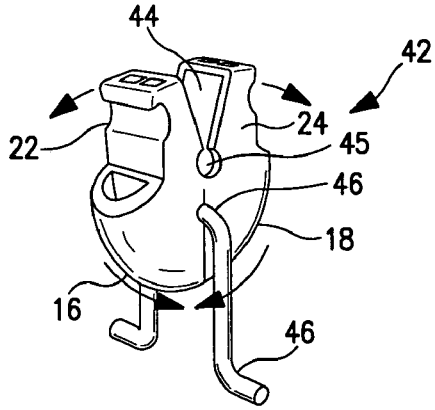
Figure 7:
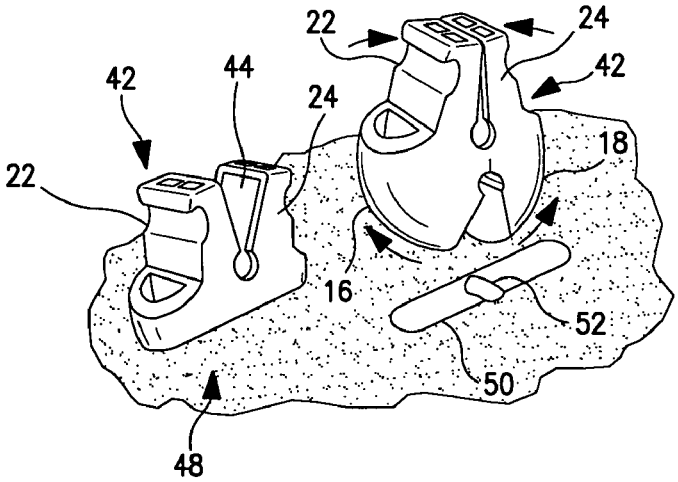

Turning now to FIGS. 5–7, use of an applicator 10, 42 in accordance with the present invention is further illustrated. For the sake of simplicity, these Figures illustrate use of the embodiment of FIG. 4. Use of the embodiment of FIG. 1 would be substantially the same.

FIG. 5 shows applicator 42 with handle members 22, 24 squeezed together to a closed position, thereby spreading recess forming members 16, 18 apart as shown. In this position, an anchor 46 can readily be positioned within anchor recess 20. Handles 22, 24 are then preferably released, as shown in FIG. 6, such that spring 44 urges handle members 22, 24 apart and further urges recess forming members 16, 18 together so as to firmly engage anchor 46 within anchor recess 20 and press recess forming members 16, 18 together along parting line 32. Applicator 42 with engaged anchor 46 is now ready for use in positioning anchor 46 within a poured concrete fabrication.

FIG. 7 shows an applicator 42 partially submerged into a liquid concrete fabrication 48, with the lower portions of recess forming members 16, 18 submerged, and with anchor 46 extending downwardly into the liquid concrete. Applicator 42 is held in this position by a user until the concrete is sufficiently hardened, at which point handle members 22, 24 can be squeezed together as also shown in the right-hand portion of FIG. 7 so as to pivot recess forming members 16, 18 away from each other, thereby releasing anchor 46 and facilitating removal of applicator 42 from concrete fabrication 48 as desired. As shown in FIG. 7, the result is anchor 46 with arms and ends (not shown in this figure) embedded within the concrete fabrication as desired, and with a recess or void 50 formed around a portion 52 of anchor 46 such that portion 52 is exposed, for example to be hooked-onto during later construction or use of the concrete fabrication as is well known in the industry.

Applicator 10, 42 may be positioned in the liquid concrete after pouring, or can be held in desired position during pouring if desired.

It should be readily appreciated that applicator 10, 42 in accordance with the present invention advantageously allows for opening of recess forming members 16, 18 to position anchor 46 in anchor recess 20 as desired, while nevertheless providing for a firm closing of recess forming members 16, 18 around anchor 46, merely by releasing handle members 22, 24, which is particularly advantageous in accordance with present invention. This serves to firmly hold anchor 46 in the desired position, and further serves to prevent leakage of liquid concrete, for example into gaps along parting line 32 or anchor recess 20, which would interfere with the quality of the anchor installation.

Applicator 10, 42 in accordance with the present invention can advantageously be formed from any suitable rubber or other flexible yet durable material.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A hand-held void forming device, comprising:

a handle comprising two handle elements moveable relative to each other;

a void forming portion having two void forming elements moveable relative to each other, said void forming portion being operatively connected to said handle whereby movement of said handle elements relative to each other moves said void forming elements relative to each other, said void forming elements in combination defining a partial disc-shaped member, wherein said void forming elements are moveable between an open position for receiving and removing of an anchor element therebetween, and a closed position wherein said void forming elements define a substantially continuous void forming surface; and a resilient member comprising a sheet of spring material associated with at least one of said handle and said void forming portion for biasing said void forming elements toward said closed position.

2. The device of claim 1, wherein said resilient member comprises a spring positioned between said handle elements.

3. The device of claim 1, further comprising an opening defined substantially at a pivot point of movement of said handle elements relative to each other.

4. The device of claim 1, wherein said void forming portion has a parting line defining said two void forming elements having surfaces which contact each other at said parting line.

5. The device of claim 4, further comprising an anchor receiving opening defined in said surfaces of said two void forming elements.

6. The device of claim 5, wherein said void forming portion has side surfaces, wherein said anchor receiving opening extends between said side surfaces, and wherein said anchor receiving opening is arced convex toward said handle member.

7. The device of claim 1, wherein the handle elements are integrally formed with and extend from the void forming elements.

8. A hand-held void forming device, comprising:

a handle comprising two handle elements moveable relative to each other;

a void forming portion having two void forming elements moveable relative to each other, said void forming portion being operatively connected to said handle whereby movement of said handle elements relative to each other moves said void forming elements relative to each other, said void forming elements in combination defining a partial disc-shaped member; and a resilient member associated with at least one of said handle and said void forming portion for biasing said void forming elements toward said closed position, wherein said resilient member comprises a spring positioned between said handle elements, further comprising an opening defined substantially at a pivot point of movement of said handle elements relative to each other, and wherein said spring is a sheet of spring material having a pivot point shaped to fit within said opening.

9. The device of claim 8, wherein the opening comprises a circular segment shaped opening traversing a segment of a circle greater than 180° and opening in a direction facing between the handle elements.

10. A hand-held void forming device, comprising:

a handle comprising two handle elements moveable relative to each other;

a void forming portion having two void forming elements moveable relative to each other, said void forming portion being operatively connected to said handle whereby movement of said handle elements relative to each other moves said void forming elements relative to each other between an open position wherein an anchor can be positioned between the void forming elements and a closed position wherein said void forming elements define a substantially continuous outer void forming surface, said void forming portion being formed of a resilient material and having a bias toward the closed position; and a further resilient member positioned between the handle elements for exerting a further closing force on the handle elements for providing additional bias toward the closed position.

11. The device of claim 10, wherein said further resilient member comprises at least one of a sheet of spring material and a resilient web positioned between said handle members.

* * * * *